US008146783B2

(12) United States Patent
Oh et al.

(10) Patent No.: US 8,146,783 B2
(45) Date of Patent: Apr. 3, 2012

(54) REFRIGERATOR HAVING DISPENSER

(75) Inventors: Seung-Hwan Oh, Seoul (KR); Ho-Youn Lee, Seoul (KR); Jun-Young Lim, Seoul (KR)

(73) Assignee: LG Electronics Inc., Seoul (KR)

( * ) Notice: Subject to any disclaimer, the term of this patent is extended or adjusted under 35 U.S.C. 154(b) by 513 days.

(21) Appl. No.: 12/402,572

(22) Filed: Mar. 12, 2009

(65) Prior Publication Data

US 2010/0147012 A1 Jun. 17, 2010

(30) Foreign Application Priority Data

Dec. 11, 2008 (KR) ..... 10-2008-0126046

(51) Int. Cl.
*B67D 3/00* (2006.01)

(52) U.S. Cl. ..... 222/504; 222/146.6; 222/516; 222/548; 62/389

(58) Field of Classification Search ..... 222/516–517, 222/533, 556, 548, 504, 146.6; 62/389–391, 62/344, 449, 394, 459, 400; 141/361–362, 141/351, 360

See application file for complete search history.

(56) References Cited

U.S. PATENT DOCUMENTS 4,069,545 A * 1/1978 Holet et al. ..... 16/49
4,227,383 A * 10/1980 Horvay ..... 62/344
4,285,212 A * 8/1981 Prada ..... 62/344
4,462,437 A * 7/1984 Prada ..... 141/360
4,555,049 A * 11/1985 Mawby et al. ..... 222/517
5,526,854 A * 6/1996 Unger ..... 141/351
5,860,564 A * 1/1999 Jablonski ..... 221/303
6,003,734 A 12/1999 Oh
6,135,173 A * 10/2000 Lee et al. ..... 141/361
7,316,121 B2 * 1/2008 Lee et al. ..... 62/344
7,383,689 B2 * 6/2008 Lee et al. ..... 62/98
7,628,032 B2 * 12/2009 Lee et al. ..... 62/344
7,980,089 B2 * 7/2011 Bowen et al. ..... 62/344
7,997,452 B2 * 8/2011 Kim et al. ..... 222/182
2007/0271949 A1 * 11/2007 Lee et al. ..... 62/389
2010/0089493 A1 * 4/2010 Seo ..... 141/351

FOREIGN PATENT DOCUMENTS

CN 1196118 A 10/1998

OTHER PUBLICATIONS

Chinese Office Action dated Mar. 2, 2011 for Application No. 200910132567.3 with English translation, 15 pages.

* cited by examiner

*Primary Examiner* — Frederick C. Nicolas
(74) *Attorney, Agent, or Firm* — Fish & Richardson P.C.

(57) ABSTRACT

Disclosed is a refrigerator having a dispenser, including a main body having a cooling chamber and a door for selectively shielding the cooling chamber. The refrigerator also includes a container accommodating unit and a communication chute that passes through a front surface of the door and guides content to a dispensing cavity defined by the container accommodating unit. The refrigerator further includes an obstruction unit disposed in the container accommodating unit, and movable, about a plane perpendicular to the front which content guided by the communication chute is relatively obstructed by the obstruction unit and a second position in which content guided by the communication chute is relatively unobstructed by the obstruction unit.

22 Claims, 7 Drawing Sheets

REFRIGERATOR HAVING DISPENSER

RELATED APPLICATION

The present application claims the benefit of priority to Korean Application No. 10-2008-0126046, filed on Dec. 11, 2008, which is herein expressly incorporated by reference in its entirety.

FIELD

The present disclosure relates to a refrigerator having a dispenser capable of dispensing content stored inside the refrigerator without opening a refrigerator door.

BACKGROUND

A refrigerator is a device which supplies cooling air generated by a refrigerating cycle to a storage chamber and maintains freshness of various food items for a long period of time. In general, a refrigerator may include a main body having a storage chamber for storing food items, and a door hinge-coupled to one side of the main body and for opening/closing the storage chamber. The main body includes refrigerating cycle components, such as a compressor, an evaporator, a condenser, an expansion valve and the like. Cooling air generated in the evaporator is supplied to the storage chamber so that food items, etc. stored in the storage chamber may be kept at a low temperature for a long period of time.

Recent refrigerator doors include dispensers, through which a user removes water or ice cubes (pieces of ices, ice, etc.) from a water supply unit or an ice making device provided in the refrigerator without opening the refrigerator door. The dispenser may include a case concavely formed at a front surface of the refrigerator door in a thickness direction, and a communication chute for connecting the case and the water supply source and/or the ice making device. A mechanism device for opening/closing the communication chute may be installed at one side of the case, and the user may dispense ice cubes or the like by putting a container into a space where the mechanism device is not installed.

SUMMARY

In one aspect, a refrigerator having a dispenser includes a main body having a cooling chamber and a door that is movable to open and close at least a portion of the cooling chamber. The refrigerator also includes a container accommodating unit that is positioned on a front surface of the door and that defines, within the door, a dispensing cavity able to accommodate at least partial insertion of a container into which content is dispensed. The front surface of the door is a surface of the door that is oriented opposite the cooling chamber when the door is in a closed position. The refrigerator further includes a communication chute that passes through the front surface of the door and that is configured to guide content to the dispensing cavity defined by the container accommodating unit. In addition, the refrigerator includes an obstruction unit disposed in the container accommodating unit, and movable, about a plane perpendicular to the front surface of the door, between at least two positions, including a first position in which content guided by the communication chute is relatively obstructed by the obstruction unit and a second position in which content guided by the communication chute is relatively unobstructed by the obstruction unit.

Implementations may include one or more of the following features. For example, the obstruction unit may include an obstruction member movable, about the plane perpendicular to the front surface of the door, between the first position in which the obstruction member covers an outlet of the communication chute and the second position in which the obstruction member does not cover the outlet of the communication chute. The obstruction unit also may include a rotation shaft coupled to the obstruction member and a driving unit configured to transfer a rotation force to the rotation shaft and, thereby, cause the obstruction member to rotate, about the plane perpendicular to the front surface of the door, between the first position and the second position. The outlet of the communication chute may have a cross section in a plane perpendicular to the front surface of the door.

In some implementations, the outlet of the communication chute may have a cross section that is inclined with respect to the plane perpendicular to the front surface of the door about which the obstruction member is movable. In these implementations, the obstruction member may be coupled to the rotation shaft in a manner that enables the obstruction member to be elastically deformed when the obstruction member covers the outlet of the communication chute, and a surface of the obstruction member that covers the communication chute may have an incline that corresponds to the inclined cross section of the communication chute.

The obstruction unit further may include an elastic member that is disposed at one side of the rotation shaft and that is configured to apply, to the rotation shaft, a restoring force that causes the obstruction member to rotate, about the plane perpendicular to the front surface of the door, from the second position to the first position. The driving unit may include a driving portion disposed in the container accommodating unit and configured to generate a linear reciprocating motion and a link member having one end thereof pin-coupled to the driving portion and another end thereof pin-coupled onto an outer surface of the rotation shaft. The link member may be configured to transfer force to the rotation shaft based on the generated linear reciprocating motion.

In some examples, the obstruction member may be coupled to an extending member extending from the rotation shaft in a radial direction. In these examples, the driving unit may include a driving portion disposed in the container accommodating unit and configured to generate a linear reciprocating motion and a link member having one end thereof pin-coupled to the driving portion and another end thereof pin-coupled to one side of the extending member. The link member may be configured to transfer force to the extending member based on the generated linear reciprocating motion.

In some implementations, the driving unit may include a rotation motor disposed in the container accommodating unit and configured to generate a rotation movement and a driving link that is coupled to a driving shaft of the rotation motor and that is configured to rotate in response to the generated rotation movement. In these implementations, the driving unit also may include a driven link that is coupled to the rotation shaft and that is configured to transfer a rotation force to the rotation shaft and a connection link having a first end pin-coupled to an end portion of the driven link and a second end pin-coupled to an end portion of the driving link. The connection link may be configured to transfer force caused by rotation of the driving link to the driven link.

The rotation motor may be installed such that the driving shaft is oriented in a direction that is toward a lower surface of the container accommodating unit. The lower surface may be a surface of the container accommodating unit that is configured to support a container into which content is dispensed.

The rotation motor may be coupled to an upper surface of the container accommodating unit. The upper surface may be a surface of the container accommodating unit through which the communication chute passes.

In some examples, the driving unit may include a rotation motor disposed in the container accommodating unit and configured to generate a rotation movement and a driving link that is coupled to the driving shaft of the rotation motor and that is configured to rotate in response to the generated rotation movement. In these examples, the driving unit also may include a connection link having one end thereof pin-coupled to a side of the extending member and another end thereof pin-coupled to the end portion of the driving link. The connection link may be configured to transfer force caused by rotation of the driving link to the extending member.

The rotation motor may be installed such that the driving shaft is oriented in a direction that is toward a lower surface of the container accommodating unit. The lower surface may be a surface of the container accommodating unit that is configured to support a container into which content is dispensed.

The rotation motor may be coupled to an upper surface of the container accommodating unit. The upper surface may be a surface of the container accommodating unit through which the communication chute passes.

The obstruction unit may be configured to slide between the first and second positions. The obstruction unit may be configured to rotate between the first and second positions. The communication chute may pass through the door and may define a passage from a content storage container positioned within the cooling chamber to the container accommodating unit.

In another aspect, a refrigerator includes a main body having a cooling chamber and a door that is movable to open and close at least a portion of the cooling chamber. The refrigerator also includes a container accommodating unit that is positioned on a front surface of the door and that defines, within the door, a dispensing cavity able to accommodate at least partial insertion of a container into which content is dispensed. The front surface of the door is a surface of the door that is oriented opposite the cooling chamber when the door is in a closed position. The refrigerator further includes a communication chute that passes through the front surface of the door and that is configured to guide content to the dispensing cavity defined by the container accommodating unit. In addition, the refrigerator includes means for moving an obstruction member, about a plane perpendicular to the front surface of the door, between at least two positions, including a first position in which content guided by the communication chute is relatively obstructed by the obstruction member and a second position in which content guided by the communication chute is relatively unobstructed by the obstruction member.

In yet another aspect, a refrigerator includes a main body having a cooling chamber and a door that is movable to open and close at least a portion of the cooling chamber. The refrigerator also includes a container accommodating unit that is positioned on a front surface of the door and that defines, within the door, a dispensing cavity able to accommodate at least partial insertion of a container into which content is dispensed. The front surface of the door is a surface of the door that is oriented opposite the cooling chamber when the door is in a closed position. The refrigerator further includes a communication chute that passes through the front surface of the door and that is configured to guide content to the dispensing cavity defined by the container accommodating unit. In addition, the refrigerator includes an obstruction member disposed in the container accommodating unit, and movable between at least two positions, including a first position in which an outlet of the communication chute is relatively obstructed by the obstruction member and a second position in which an outlet of the communication chute is relatively unobstructed by the obstruction member. The obstruction member is configured to move from the first position to the second position without any portion of the obstruction member further invading an area of the dispensing cavity directly below the outlet of the communication chute than when the obstruction member is in the first position.

Implementations may include one or more of the following features. For example, the obstruction member may be configured to move from the first position to the second position in a plane that is perpendicular to a front surface of the door. The refrigerator may include a tray configured to support a container accommodated by the container accommodating unit and into which content is dispensed and wherein the obstruction member may be configured to move from the first position to the second position in a plane that is parallel to a surface of the tray that supports a container.

The obstruction member may be configured to move from the first position to the second position in a plane that is parallel to a cross section of the outlet of the communication chute. The obstruction member may be configured to rotate from the first position to the second position. The obstruction member may be configured to slide from the first position to the second position.

DETAILED DESCRIPTION

In some implementations, a refrigerator includes a dispenser configured to dispense content (e.g., liquid water, ice, etc.). For example, the refrigerator may include an ice maker that freezes liquid water into ice cubes, and the dispenser may dispense the ice cubes from a storage bin positioned in the refrigerator through a door of the refrigerator. In this example, the refrigerator also may include a dispenser housing that is positioned on an exterior surface of the door and that defines, within the door, a dispensing cavity that accommodates a container being filled by the dispenser. A communication chute may pass through the door of the refrigerator and guide ice cubes from the storage bin to the dispensing cavity defined by the dispenser housing. To control dispensing of content, an obstruction member may be controlled to move between a first position that obstructs content from being guided by the communication chute (e.g., a first position in which the obstruction member covers an outlet of the communication chute) and a second position that does not obstruct content from being guided by the communication chute (e.g., a second position in which the obstruction member opens an outlet of the communication chute).

In order to increase an area of the dispensing cavity in which a container may be placed by a user, the obstruction member may be configured to move from the first position to the second position without any portion of the obstruction member further invading a portion of the dispensing cavity that accommodates a container at a position to receive content. In this regard, the obstruction member does not further invade an area of the dispensing cavity directly below the outlet of the communication chute any more so than when the obstruction member is in the first position. For example, the obstruction member may move in a plane perpendicular to the exterior surface of the door, in a plane parallel to a tray configured to support a container placed within the dispensing cavity, and/or in a plane parallel to a cross-section of the outlet of the communication chute. In these examples, while content is being dispensed, the obstruction member is stored at a top portion of the dispensing cavity next to or adjacent the outlet of the communication chute. Because the obstruction member does not further invade an area of the dispensing cavity directly below the outlet of the communication chute when opening the communication chute, an area or height of the dispensing cavity that is capable of accommodating a container may be increased. In this configuration, a taller container may be placed in the dispensing cavity (or a container may be placed closer to the outlet of the communication chute) because the obstruction member will not contact the container as the obstruction member moves to open the communication chute.

Figure 1:
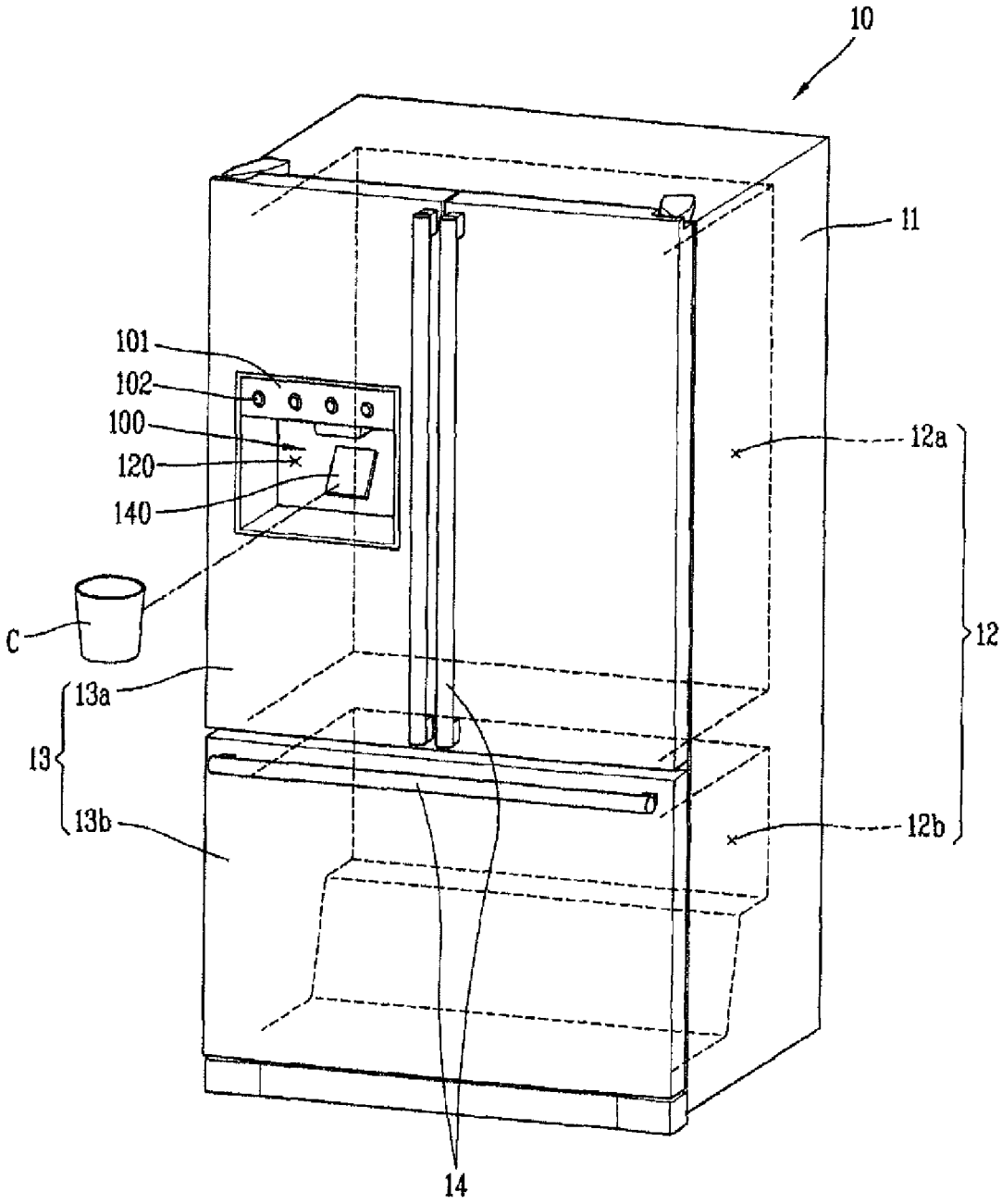
FIG. 1 is a perspective view showing an outer appearance of a refrigerator having a dispenser.

Referring to FIG. 1, one implementation of a refrigerator 10 having a dispenser 100 includes a main body 11 having a cooling chamber 12 and a door 13. Although not shown, a refrigerating cycle including a compressor, a condenser, an expansion unit and an evaporator is provided to cool the cooling chamber 12.

The main body 11 has a rectangular box shape, and includes the cooling chamber 12 having an opened front surface therein. An insulating material is positioned in a space defined by a wall body of the cooling chamber 12, i.e., a wall of the cooling chamber 12 and an outer wall of the main body 11, thereby insulating the cooling chamber 12 from an exterior of the main body 11.

The insulating material is generally formed by filling and hardening a liquid blowing agent.

The cooling chamber 12 is divided into a plurality of spaces having different storage temperatures and storage environment, such as a refrigerating chamber, a freezing chamber, a fresh food chamber, a vegetable compartment, a rice compartment, and the like. In general, the cooling chamber 12 includes a refrigerating chamber 12*a* for keeping food items in storage in a cool state at an above-freezing temperature, and a freezing chamber 12*b* for keeping food items in a frozen state at a below-freezing temperature.

Air cooled while passing through the evaporator is circulated to the inside of the cooling chamber 12 via a cooling air supply passage provided in the main body 11, thereby cooling the inside of the cooling chamber 12.

Regarding a position of the freezing chamber 12*b* and the refrigerating chamber 12*a*, a traditional format is that the refrigerating chamber 12*a* is disposed below the freezing chamber 12*b* (a top freezer type). In addition to the traditional format, there are different types including a side-by-side type, a bottom-freezer type and the like. The bottom-freezer type is shown in FIG. 1.

The door 13 may be hinge-coupled to the main body 11 (13*a*) or coupled to the main body 11 so as to be slidable front and back (13*b*). The door 13 is configured to selectively open/close the opened front surface of the cooling chamber 12.

In addition, the door 13 may further include a door handle 14 to facilitate the opening/closing of the door 13.

Similar to the wall body forming the cooling chamber 12, an insulating material is inserted inside the door 13 so as to insulate the cooling chamber 12 from an outside.

Regarding the number of the doors 13, two or more doors 13 may be provided, in addition to a traditional type in which each cooling chamber 12 has one door.

In this exemplary implementation, the door 13 further includes a dispenser 100 for drawing out ice cubes (ice pieces, ice, etc.) stored inside the cooling chamber 12.

The dispenser 100 may be positioned in any location so long as a user may draw out ice cubes stored inside the cooling chamber 12 from outside the main body 11, without opening the door 13. Hereinafter, the dispenser 100, as shown in FIG. 1, is assumed to be provided at the door 13*a* of the refrigerating chamber 12*a*.

The dispenser 100 includes a container accommodating unit 120 concavely defined from the front surface of the door 13*a* in a thickness direction and having an opened front surface, a shielding unit 101 disposed at an upper portion of the container accommodating unit 120, and a lever unit 140. The shielding unit 101 may shield components of the dispenser 100 so as not to be seen from the outside. The lever unit 140 may generate an operation signal of the dispenser 100 and may be positioned at a rear surface of the container accommodating unit 120.

Here, the shielding unit 101 may include a control button unit 102 for controlling operations of the dispenser 100 or controlling operations of the refrigerator 10.

Figure 2:
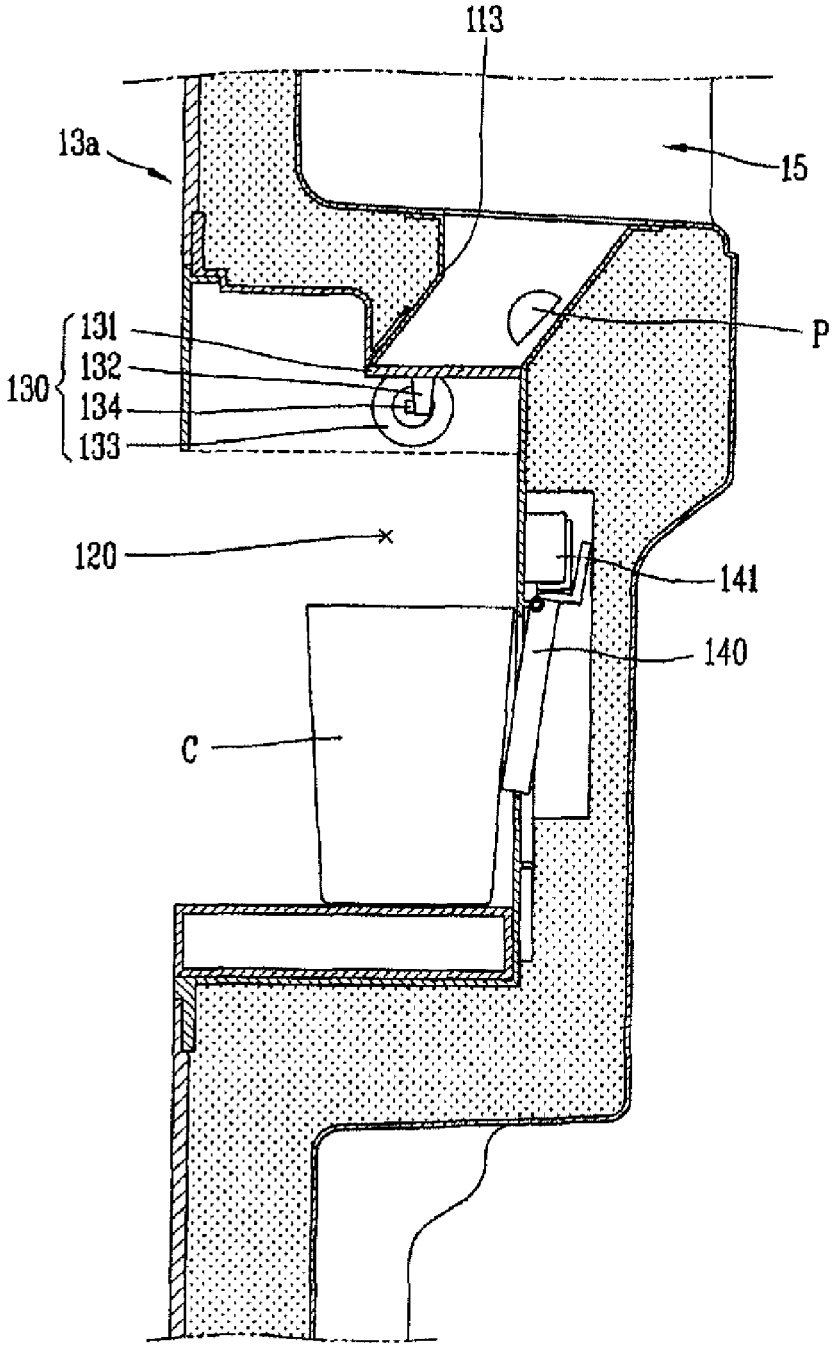
FIG. 2 is a cross-sectional view showing the dispenser in FIG. 1.

Referring to FIG. 2, one implementation of the dispenser 100 includes a communication chute 113 that passes through the door 13 so as to communicate inside and outside the door 13, and an opening/closing unit 130 for opening/closing an end portion of the communication chute 113 connected to the inside of the container accommodating unit 120 by being moved in a thickness direction thereof.

Here, the communication chute 113 is configured to define a path that connects the inside of the cooling chamber 12 and the inside of the container accommodating unit 120, which is concavely formed from an outer surface of the door 13. The path may extend from an ice compartment 15 positioned inside of the cooling chamber 12. The ice compartment 15 may include an ice storage bin that stores ice pieces and an ice maker that freezes liquid water into ice pieces.

In addition, the communication chute 113 is downwardly inclined in a direction facing the container accommodating unit 120. The downward incline enables the communication chute to guide a piece of ice P from the inside of the cooling chamber 12 to the container accommodating unit 120 using the force of gravity.

In addition, the communication chute 130, which is open/closed by the opening/closing unit 130, has a horizontal cross section.

Meanwhile, the lever unit 140 is elastically supported and may be pressed by a container C. As the lever unit 140 is pressed, an operation switch 141 disposed at one side of the container accommodating unit 120 is activated by the lever unit 140.

The opening/closing unit 130 includes an opening/closing member 131 configured to move in a thickness direction of the communication chute 113 so as to open/close the cross section of an opening of the communication chute 113, a rotation shaft 132 coupled to the opening/closing member 131, and a driving unit 133, 134 for rotating the rotation shaft 132. For instance, the opening/closing member 131 may move in a plane perpendicular to an exterior surface of the door, in a plane parallel to a tray configured to support a container placed within the container accommodating unit 120, and/or in a plane parallel to a cross-section of an outlet of the communication chute 113.

Detailed descriptions of the configuration and operation of the opening/closing unit 130 will be given with reference to FIGS. 3 and 4.

Figure 3:
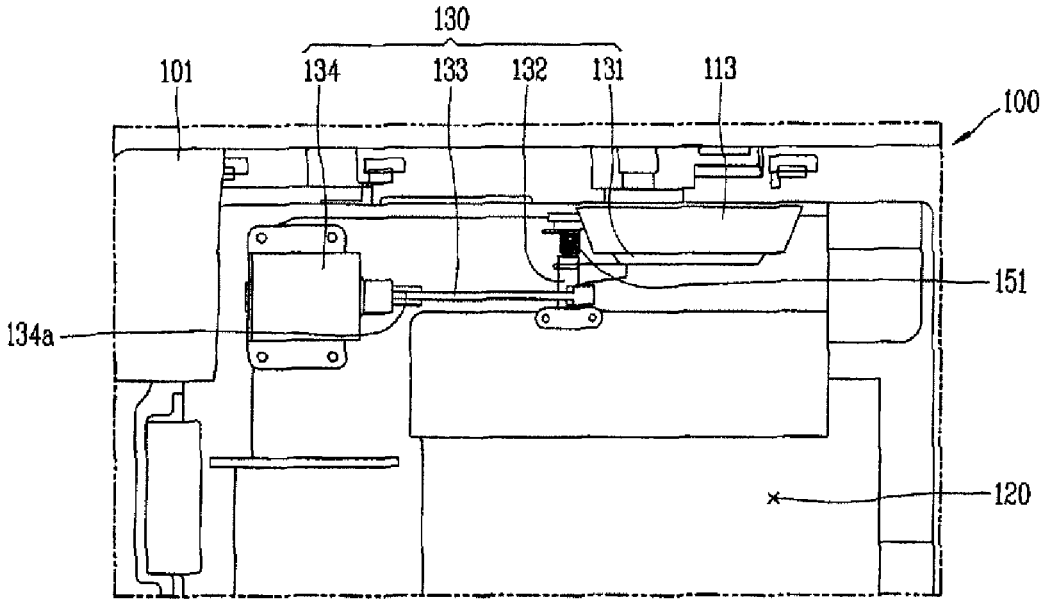
FIG. 3 is a view showing the dispenser in a closed state of an opening/closing member in FIG. 1.
Figure 4:
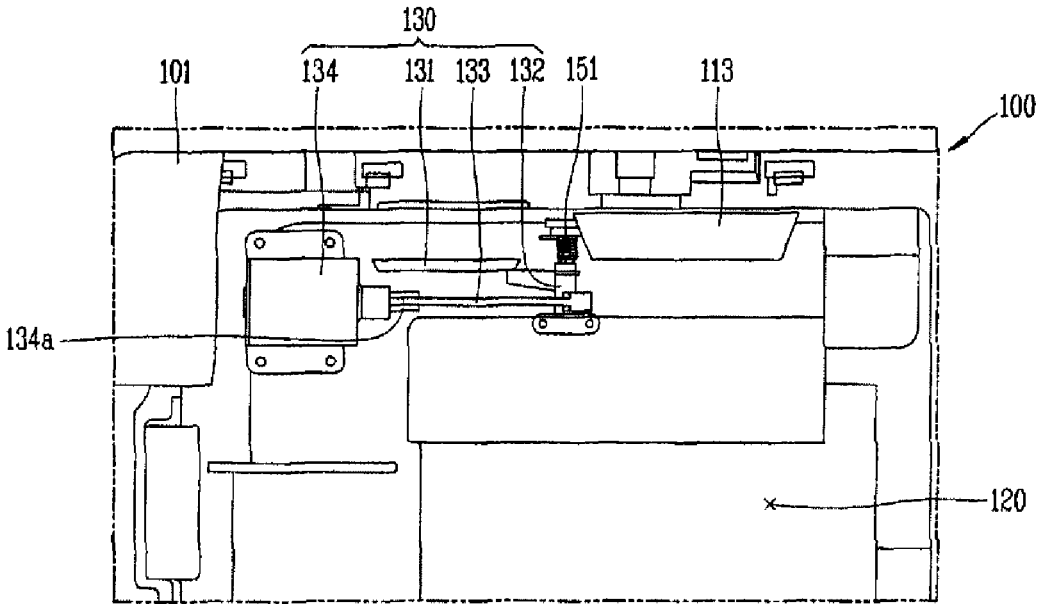
FIG. 4 is a view showing the dispenser in an opened state of the opening/closing member in FIG. 3.

Referring to FIGS. 3 and 4, the opening/closing unit 130 is positioned at an upper portion of the container accommodating unit 120, and is shielded by the shielding unit 101. The rotation shaft 132 is perpendicularly disposed at an upper portion of the container accommodating unit 120, and upper and lower ends thereof are hinge-coupled to rotate in a pendulum manner.

The opening/closing member 131 is coupled to the rotation shaft 132 such that the horizontal cross section of an opening of the communication chute 113 is open/closed as the opening/closing member 131 moves in the thickness direction of the communication chute 113.

The driving unit 133, 134 includes a driving portion 134 for generating a linear reciprocating motion, and a link member 133 having one end thereof pin-coupled to a driving shaft 134*a* of the driving portion 134 and another end thereof pin-coupled onto an outer surface of the rotation shaft 132.

The driving portion 134 may be implemented as a solenoid in which a plunger performs a linear reciprocating motion by a magnetic force (magnetism), a thermal actuator which generates a linear reciprocating motion by thermal expansion, or the like.

In addition, the driving portion 134 is installed such that the driving shaft 134*a* thereof is toward the opening/closing member 131.

Meanwhile, the opening/closing unit 130 further includes an elastic member 151 such that a restoring force is applied to the opening/closing member 131 in a direction that moves the opening/closing member 131 to close the communication chute 113.

The elastic member 151 may be implemented as a cylindrical torsion spring. In this instance, the elastic member 151 is fitted into the rotation shaft 132 such that one end thereof is fixed to one side of the container accommodating unit 120 and another end thereof is fixed to one side of the rotation shaft 132 or one side of the opening/closing member 131.

The opening/closing member 131 receives an elastic force by the elastic member 151 in a direction that moves the opening/closing member 131 to close the communication chute 113, thereby enhancing a sealing capability of the communication chute 113 and reducing a leakage of cooling air via the communication chute 113.

Hereinafter, description of a process for opening/closing the communication chute 113 by the opening/closing unit 130 will be given in detail.

If the operation signal of the dispenser 100 in the refrigerator is transferred to the driving portion 134, the driving shaft 134*a* of the driving portion 134 is moved to the inside of the driving portion 134.

While the link member 133 pin-coupled to the driving shaft 134*a* is moved in a moving direction of the driving shaft 134*a*, the rotation shaft 132 pin-coupled to the other end of the link member 133 is rotated.

Here, because the other end of the link member 133 is pin-coupled to the outer surface of the rotation shaft 132, a radius of the rotation shaft 132 may be a radius of gyration.

Meanwhile, the opening/closing member 131 coupled to the rotation shaft 132, together with the rotation of the rotation shaft 132, moves to rotate in a direction toward the driving unit 134 in FIG. 3, thereby opening the communication chute 113.

Thereafter, ice cubes or the like stored in the cooling chamber 12 are drawn out through the communication chute 113.

Conversely, if a signal notifying that a dispensing operation has been completed is transferred to the driving portion 134, the driving shaft 134*a* of the driving portion 134 outwardly protrudes from the driving portion 134, and the link member 133 pin-coupled to the driving shaft 134*a* is moved in a corresponding manner. Consequently, the opening/closing member 131 coupled to the rotation shaft 132 is rotated in a direction away from the driving unit 134 in FIG. 4.

Because the communication chute 113 is open/closed while the opening/closing member 131 is horizontally moved, the dispenser 100 may have an advantage of increasing a height of the container accommodating unit 120, as compared to other constructions in which the communication chute 113 is open/closed while the opening/closing member swings downward toward a container receiving space defined by the container accommodating unit 120.

Figure 5:
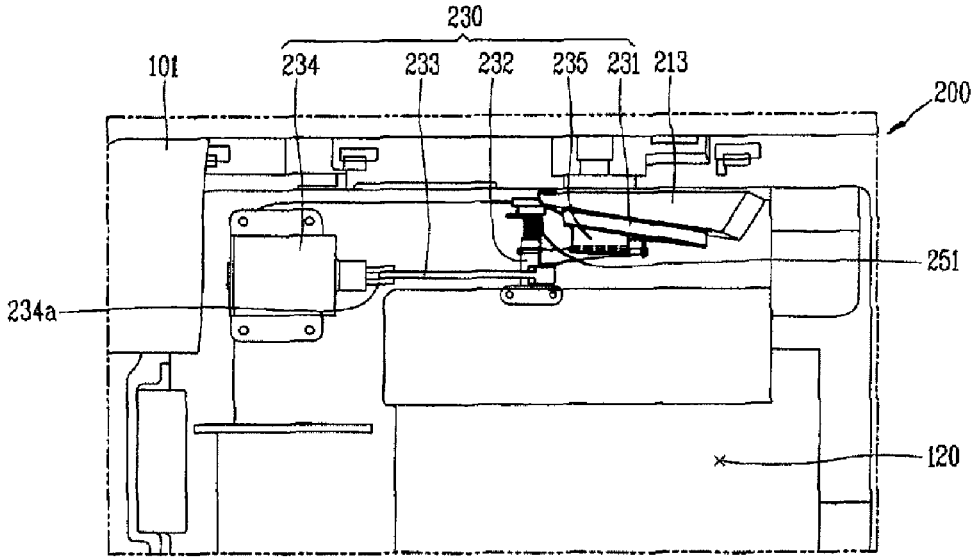
FIG. 5 is a view showing a dispenser in a closed state of an opening/closing member in a refrigerator having a dispenser.
Figure 6:
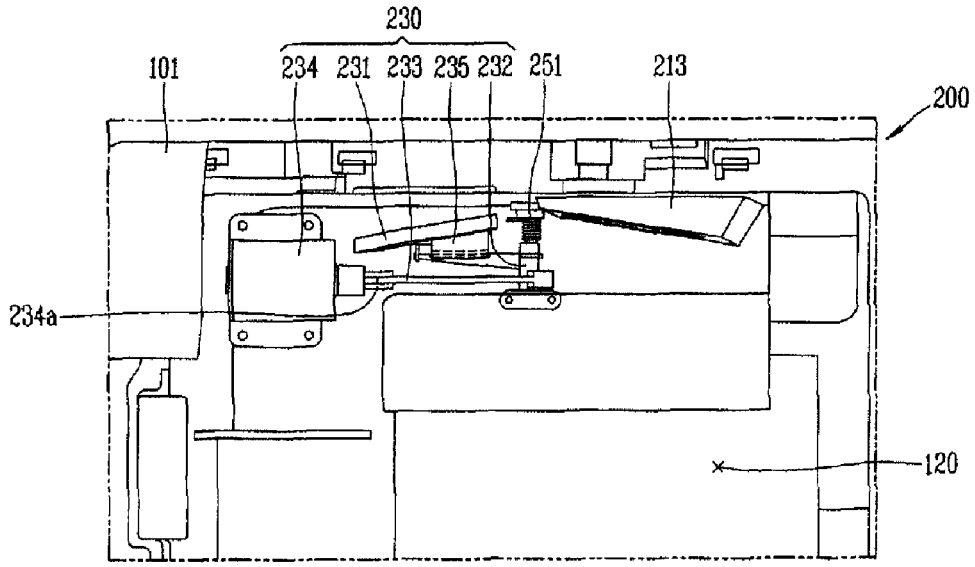
FIG. 6 is a diagram showing the dispenser in an opened state of the opening/closing member in FIG. 5.

Referring to FIGS. 5 and 6, in the refrigerator 10 having a dispenser 200, the dispenser 200, as described above, includes the container accommodating unit 120, a communication chute 213, and an opening/closing unit 230 having an opening/closing member 231, a rotation shaft 232, a link member 233, a driving portion 234 with a driving shaft 234*a*, and an elastic member 251.

It should be noted in this example a cross section of an opening of the communication chute 213 being open/closed by the opening/closing member 231 is downwardly inclined in a direction the communication chute 213 is closed by the opening/closing member 231. In this example, the opening/closing member 231 is coupled to the rotation shaft 232 so as to be elastically deformed so that it corresponds to the downward-inclined section of the communication chute 213 when the communication chute 213 is closed. With such configuration, the opening/closing member 231 is elastically deformed along the inclination of the opening of the communication chute 213 when the communication chute 213 is closed. Thereby, the dispenser 200 may have an advantage of enhancing the sealing capability of the communication chute 213 by the opening/closing member 231.

Figure 7:
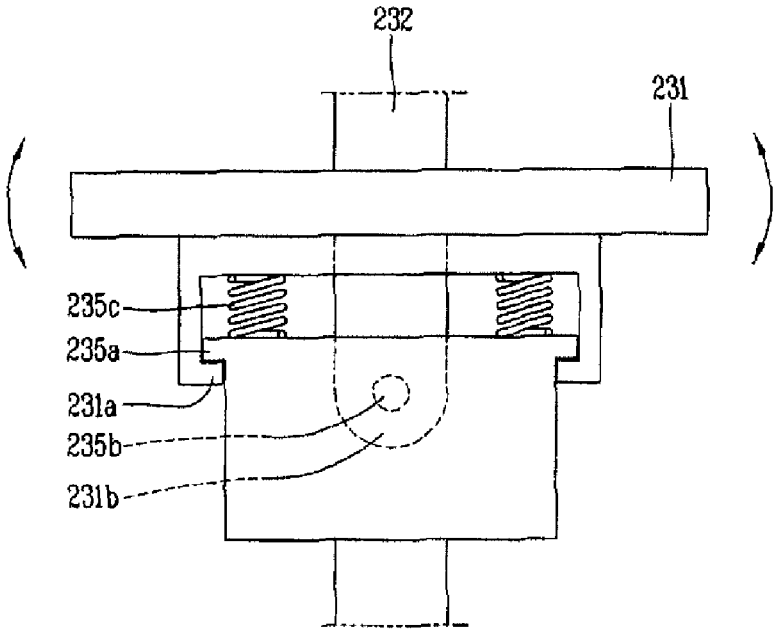
FIG. 7 is a cross-sectional view showing a coupling structure of an opening/closing member and a rotation shaft, in the refrigerator having the dispenser shown in FIGS. 5 and 6.

Meanwhile, in this example, the coupling of the opening/closing member 231 and the rotation shaft 232 may be modified as shown in FIG. 7.

Referring to FIGS. 5 through 7, the opening/closing member 231 is coupled to an extending member 235 that extends from the rotation shaft 232 in a radial direction.

For this, an end of the extending member 235 is provided with a hinge protrusion 235*b* hinge-coupled to a protruding portion 231*b* downwardly protruding from a lower surface of the opening/closing member 231. A stopping protrusion 235*a* vertically protrudes from each upper end of both side surfaces of the extending member 235.

In addition, hooks 231*a* are positioned to face each other at the lower surface of the opening/closing member 231.

Meanwhile, an elastic member 235*c* is positioned in a space defined between the lower surface of the opening/closing member 231 defined when the hook 231*a* contacts the stopping protrusion 235*a*, and an upper surface of the extending member 235.

The elastic member 235*c* is respectively provided at both sides (right and left) based on a virtual line connecting the rotation shaft 232 and the hinge protrusion 235*b*. In some examples, a plurality of elastic members 235*c* is provided. The elastic member 235*c* applies a force to the opening/closing member 231 such that the opening/closing member 231 is pressed against the opening of the communication chute 213 when the opening/closing member 231 is in a position to close the communication chute 213. In this configuration, the contact between the opening/closing member 231 and the communication chute 213 counteracts the force provided by the elastic member 235*c*, rather than the hooks 231*a* contacting the stopping protrusions 235*a*. The force provided by the elastic member 235*c* may cause the opening/closing member 231 to provide a better seal of the opening of the communication chute 213. When the opening/closing member 231 is in a position to open the communication 213, the hooks 231*a* contact the stopping protrusions 235*a* and, thereby, hold the opening/closing member 231 in place.

Figure 8:
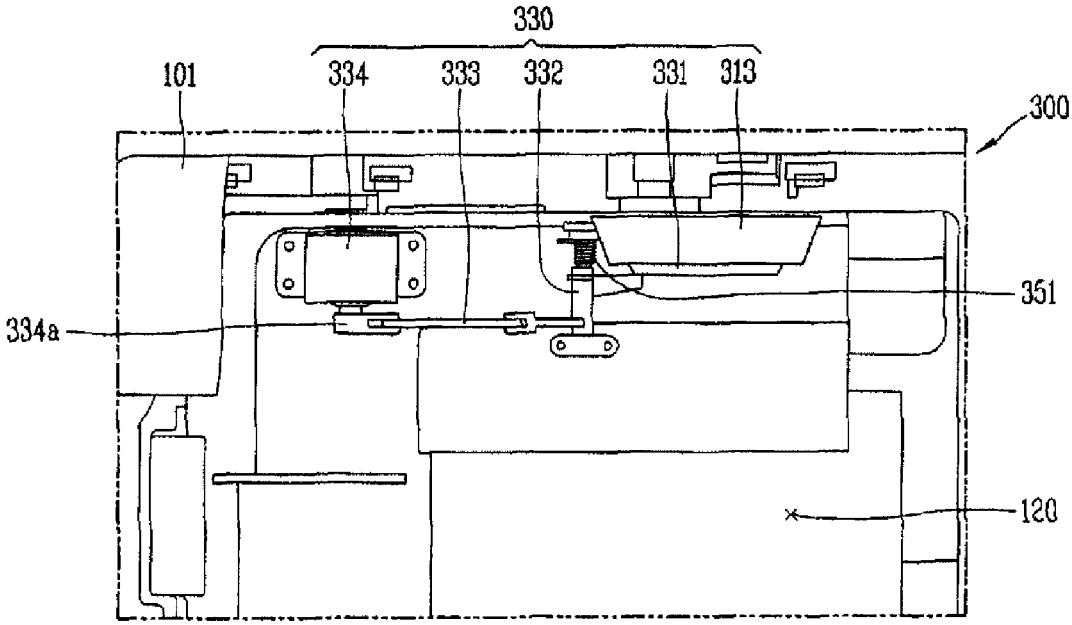
FIG. 8 is a view showing the dispenser in a closed state of an opening/closing member in a refrigerator having a dispenser.
Figure 9:
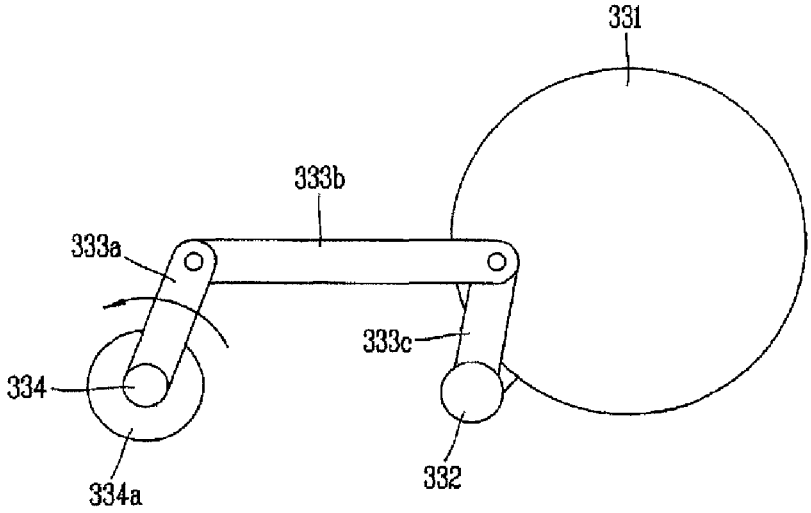
FIG. 9 is a view showing a driving unit and the opening/closing member in FIG. 8 viewed from a rear surface of a container accommodating unit.

Referring to FIGS. 8 and 9, in the refrigerator 10 having a dispenser 300, the dispenser 300 includes the container accommodating unit 120, a communication chute 313, and an opening/closing unit 330 having an opening/closing member 331, a rotation shaft 332, a link member 333, a rotation motor 334, and an elastic member 351.

It should be noted in this example that the opening/closing unit 330 includes a rotation motor 334 for generating a rotation motion, instead of the driving portion 134 described above.

In addition, the opening/closing unit 330 includes, instead of the link member 133 described above, a driving link 333*a* rotating by being vertically coupled to the driving shaft 334*a* of the rotation motor 334, a driven link 333*c* vertically fixed to the rotation shaft 332 and transferring a rotation force to the rotation shaft 332, and a connection link 333*b* having both ends thereof each pin-coupled to an end of the driven link 333*c* and an end portion of the driving link 333*a*.

With such configuration, a four-link mechanism is formed as a virtual link for connecting the driving link 333*a*, the connection link 333*b*, the driven link 333*c*, the driving shaft 334*a* of the rotation motor 334 and the rotation shaft 332. Accordingly, as the rotation motor 334 rotates, the driving link 333*a*, the driven link 333*c* and the connection link 333*b* perform a motion on a coplanar surface. The opening/closing member 331 coupled to the rotation shaft 332 being shaft-rotated by the driven link 333*c* causes the opening/closing of the communication chute 313.

In some implementations, the rotation motor 334 is installed such that the driving shaft 334*a* thereof is toward a lower surface of the container accommodating unit 120.

In addition, the driven link 333*c* may be coupled to the rotation shaft 332 at a lower position than where the opening/closing member 331 is coupled to the rotation shaft 332.

In this example, the rotation motor 334 may be inserted to be fixed onto an upper surface of the container accommodating unit 120.

In the dispenser 300, the rotation motor 334 is employed, thereby having an effect of preventing a collision sound generated when a solenoid or a thermal actuator performs a linear reciprocating motion.

Figure 10:
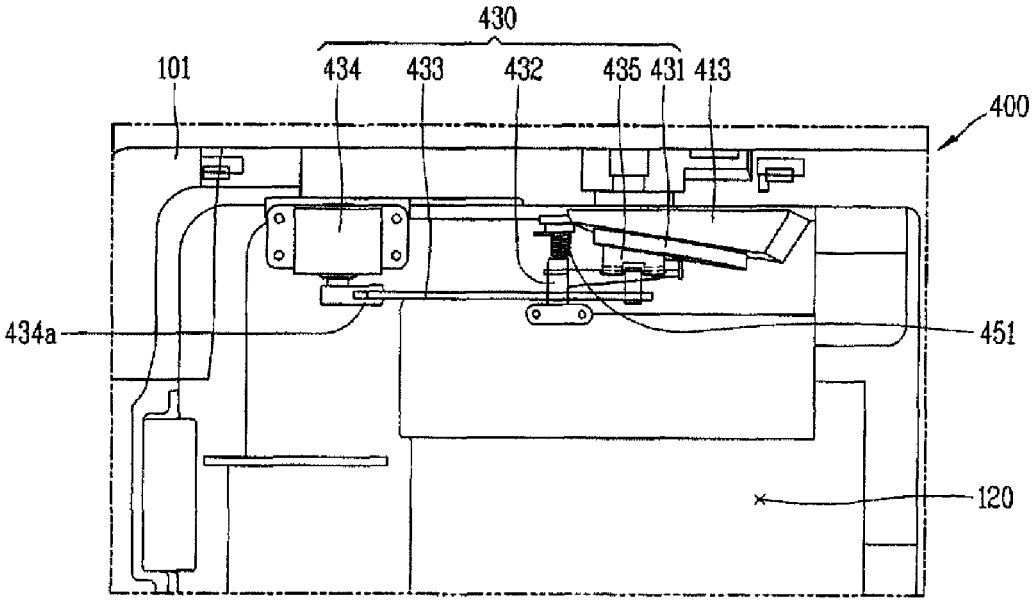
FIG. 10 is a view showing a dispenser in a closed state of an opening/closing member in a refrigerator having a dispenser.
Figure 11:
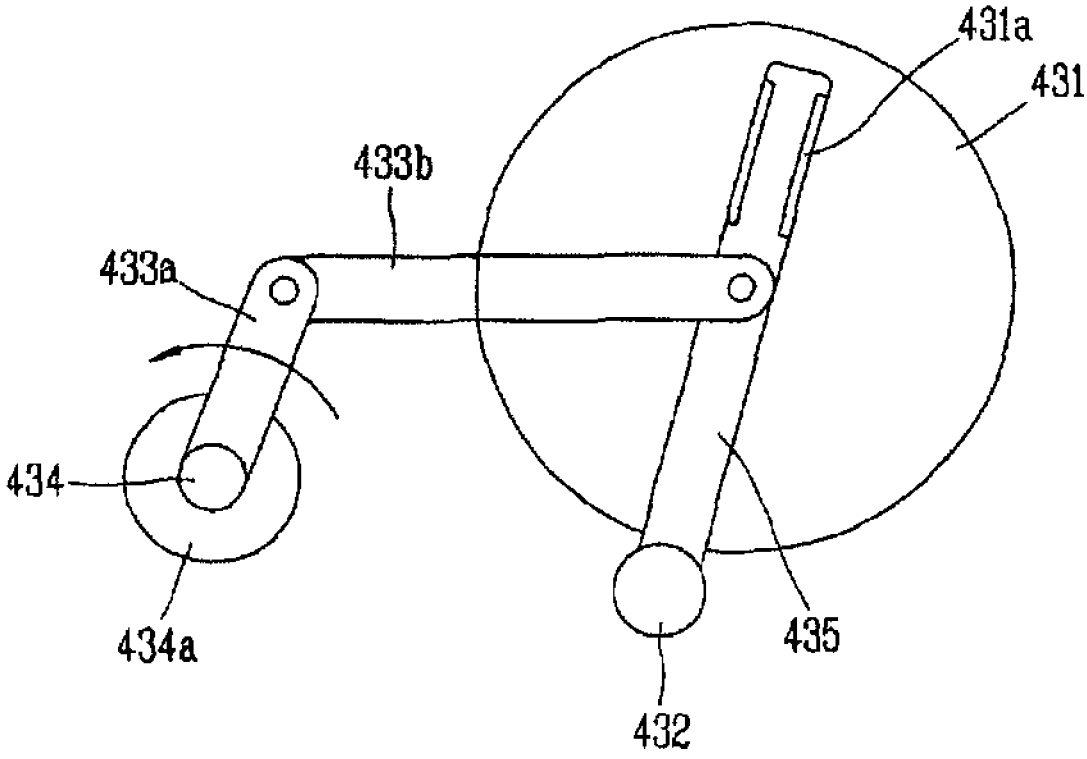
FIG. 11 is a view showing a driving unit and the opening/closing member in FIG. 10 viewed from a rear surface of a container accommodating unit.

Referring to FIGS. 10 and 11, in the refrigerator 10 having a dispenser 400, the dispenser 400, as described above, includes the container accommodating unit 120, a communication chute 413, and an opening/closing unit 430 having an opening/closing member 431, a rotation shaft 432, a link member 433, a rotation motor 434, and an elastic member 451.

In the dispenser 400, the opening/closing unit 430 includes a rotation motor 434 for generating a rotation movement, a driving link 433*a* rotating by being coupled to the driving shaft 434*a* of the rotation motor 434, an extending member 435 extending from the rotation shaft 432 in a radial direction and coupled to the opening/closing member 431 so as to be elastically deformed, and a connection link 433*b* having one end thereof pin-coupled to one side of the extending member 435 and another_end thereof pin-coupled to an end portion of the driving link 433*a*.

In the dispenser 400, a cross section of an opening of the communication chute 413 that is opened/closed by the opening/closing member 431 is downwardly inclined in a direction the communication chute 413 is closed by the opening/closing member 413.

By this, when the communication chute 413 is closed, the opening/closing member 431 is elastically deformed along an inclination formed on the cross section of the communication chute 413. Thereby, the dispenser 400 may have an advantage of enhancing the sealing capability of the communication chute 413 by the opening/closing member 431.

In this example, the coupling structure between the opening/closing member 431 and the extending member 435 is substantially the same as that described above with respect to the extending member 235, and detailed explanations therefor are omitted.

Further, the opening/closing member 431 may be coupled to the rotation shaft 432 so as to be elastically deformed so that it corresponds to the downward-inclined section of the communication chute 413 when the communication chute 413 is closed.

As described above, in some implementations of the refrigerator having a dispenser, the opening/closing unit moves in a thickness direction of the communication chute so as to selectively open/close the communication chute, thereby reducing an installation space of the opening/closing unit. Thus, a height for enabling accommodation of containers, etc., may be increased without increasing a size of the container accommodating unit.

Although the opening/closing unit has primarily been described as being movable using rotational movement, other implementations may involve moving the opening/closing unit with other types of movement. For example, the opening/closing unit may be configured to slide an opening/closing member between a first position in which the opening/closing member covers an opening of the communication chute to a second position in which the opening/closing member does not cover an opening of the communication chute. In this example, a driving unit may generate a reciprocating linear motion and the reciprocating linear motion may be used to slide the opening/closing member from the first position to the second position.

In addition, the orientation of the opening/closing unit may cause the opening/closing unit to move (e.g., rotate, slide, etc.) the opening/closing member in any direction. For instance, the opening/closing unit may move (e.g., rotate, slide, etc.) the opening/closing member toward a front of the container accommodating unit that is open to receive a container, either side of the container accommodating unit, or a rear of the container accommodating unit. Orienting the opening/closing unit to move (e.g., rotate, slide, etc.) the opening/closing member toward one of the sides of the container accommodating unit may enable a decrease in a thickness of the door needed to house the container accommodating unit and, thereby, increase an amount of usable space within the cooling chamber.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. A refrigerator having a dispenser, comprising:

a main body having a cooling chamber and a door that is movable to open and close at least a portion of the cooling chamber;

a container accommodating unit that is positioned on a front surface of the door and that defines, within the door, a dispensing cavity able to accommodate at least partial insertion of a container into which content is dispensed, the front surface of the door being a surface of the door that is oriented opposite the cooling chamber when the door is in a closed position;

a communication chute that passes through the front surface of the door and that is configured to guide the content to the dispensing cavity defined by the container accommodating unit; and an obstruction unit disposed in the container accommodating unit, and movable, about a plane perpendicular to the front surface of the door, between at least two positions, including a first position in which the content guided by the communication chute is relatively obstructed by the obstruction unit and a second position in which the content guided by the communication chute is relatively unobstructed by the obstruction unit, wherein the obstruction unit comprises:

an obstruction member movable, about the plane perpendicular to the front surface of the door, between the first position in which the obstruction member covers an outlet of the communication chute and the second position in which the obstruction member does not cover the outlet of the communication chute;

a rotation shaft coupled to the obstruction member; and a driving unit configured to transfer a rotation force to the rotation shaft and, thereby, cause the obstruction member to rotate, about the plane perpendicular to the front surface of the door, between the first position and the second position.

2. The refrigerator having a dispenser of claim 1, wherein the outlet of the communication chute has a cross section in a plane perpendicular to the front surface of the door.

3. The refrigerator having a dispenser of claim 1, wherein the outlet of the communication chute has a cross section that is inclined with respect to the plane perpendicular to the front surface of the door about which the obstruction member is movable.

4. The refrigerator having a dispenser of claim 3, wherein the obstruction member is coupled to the rotation shaft in a manner that enables the obstruction member to be elastically deformed when the obstruction member covers the outlet of the communication chute, and a surface of the obstruction member that covers the communication chute has an incline that corresponds to the inclined cross section of the communication chute.

5. The refrigerator having a dispenser of claim 1, wherein the obstruction unit further comprises an elastic member that is disposed at one side of the rotation shaft and that is configured to apply, to the rotation shaft, a restoring force that causes the obstruction member to rotate, about the plane perpendicular to the front surface of the door, from the second position to the first position.

6. The refrigerator having a dispenser of claim 1, wherein the driving unit comprises:

a driving portion disposed in the container accommodating unit and configured to generate a linear reciprocating motion; and a link member having one end thereof pin-coupled to the driving portion and another end thereof pin-coupled onto an outer surface of the rotation shaft, the link member being configured to transfer force to the rotation shaft based on the generated linear reciprocating motion.

7. The refrigerator having a dispenser of claim 1, wherein the obstruction member is coupled to an extending member extending from the rotation shaft in a radial direction.

8. The refrigerator having a dispenser of claim 7, wherein the driving unit comprises:

a driving portion disposed in the container accommodating unit and configured to generate a linear reciprocating motion; and a link member having one end thereof pin-coupled to the driving portion and another end thereof pin-coupled to one side of the extending member, the link member being configured to transfer force to the extending member based on the generated linear reciprocating motion.

9. The refrigerator having a dispenser of claim 1, wherein the driving unit comprises:

a rotation motor disposed in the container accommodating unit and configured to generate a rotation movement;

a driving link that is coupled to a driving shaft of the rotation motor and that is configured to rotate in response to the generated rotation movement;

a driven link that is coupled to the rotation shaft and that is configured to transfer a rotation force to the rotation shaft; and a connection link having a first end pin-coupled to an end portion of the driven link and a second end pin-coupled to an end portion of the driving link, the connection link being configured to transfer force caused by rotation of the driving link to the driven link.

10. The refrigerator having a dispenser of claim 9, wherein the rotation motor is installed such that the driving shaft is oriented in a direction that is toward a lower surface of the container accommodating unit, the lower surface being a surface of the container accommodating unit that is configured to support a container into which the content is dispensed.

11. The refrigerator having a dispenser of claim 9, wherein the rotation motor is coupled to an upper surface of the container accommodating unit, the upper surface being a surface of the container accommodating unit through which the communication chute passes.

12. The refrigerator having a dispenser of claim 7, wherein the driving unit comprises:

a rotation motor disposed in the container accommodating unit and configured to generate a rotation movement;

a driving link that is coupled to the driving shaft of the rotation motor and that is configured to rotate in response to the generated rotation movement; and a connection link having one end thereof pin-coupled to a side of the extending member and another end thereof pin-coupled to the end portion of the driving link, the connection link being configured to transfer force caused by rotation of the driving link to the extending member.

13. The refrigerator having a dispenser of claim 12, wherein the rotation motor is installed such that the driving shaft is oriented in a direction that is toward a lower surface of the container accommodating unit, the lower surface being a surface of the container accommodating unit that is configured to support a container into which the content is dispensed.

14. The refrigerator having a dispenser of claim 12, wherein the rotation motor is coupled to an upper surface of the container accommodating unit, the upper surface being a surface of the container accommodating unit through which the communication chute passes.

15. The refrigerator having a dispenser of claim 1, wherein the obstruction unit is configured to slide between the first and second positions.

16. The refrigerator having a dispenser of claim 1, wherein the obstruction unit is configured to rotate between the first and second positions.

17. The refrigerator having a dispenser of claim 1, wherein the communication chute passes through the door and defines a passage from a content storage container positioned within the cooling chamber to the container accommodating unit.

18. A refrigerator comprising:

a main body having a cooling chamber and a door that is movable to open and close at least a portion of the cooling chamber;

a container accommodating unit that is positioned on a front surface of the door and that defines, within the door, a dispensing cavity able to accommodate at least partial insertion of a container into which content is dispensed, the front surface of the door being a surface of the door that is oriented opposite the cooling chamber when the door is in a closed position;

a communication chute that passes through the front surface of the door and that is configured to guide the content to the dispensing cavity defined by the container accommodating unit; and means for moving an obstruction member coupled to a rotation shaft, about a plane perpendicular to the front surface of the door, between at least two positions, including a first position in which the content guided by the communication chute is relatively obstructed by the obstruction member and a second position in which the content guided by the communication chute is relatively unobstructed by the obstruction member, wherein the rotation shaft is perpendicularly disposed at an upper portion of the container accommodating unit, and wherein the obstruction member is configured to rotate from the first position to the second position in response to rotation of the rotation shaft.

19. A refrigerator comprising:

a main body having a cooling chamber and a door that is movable to open and close at least a portion of the cooling chamber;

a container accommodating unit that is positioned on a front surface of the door and that defines, within the door, a dispensing cavity able to accommodate at least partial insertion of a container into which content is dispensed, the front surface of the door being a surface of the door that is oriented opposite the cooling chamber when the door is in a closed position;

a communication chute that passes through the front surface of the door and that is configured to guide the content to the dispensing cavity defined by the container accommodating unit; and an obstruction member disposed in the container accommodating unit, and movable between at least two positions, including a first position in which an outlet of the communication chute is relatively obstructed by the obstruction member and a second position in which an outlet of the communication chute is relatively unobstructed by the obstruction member, the obstruction member being configured to move from the first position to the second position without any portion of the obstruction member further invading an area of the dispensing cavity directly below the outlet of the communication chute than when the obstruction member is in the first position, wherein the obstruction member is configured to rotate from the first position to the second position.

20. The refrigerator of claim 19 wherein the obstruction member is configured to move from the first position to the second position in a plane that is perpendicular to a front surface of the door.

21. The refrigerator of claim 19 further comprising:

a tray configured to support a container accommodated by the container accommodating unit and into which the content is dispensed, wherein the obstruction member is configured to move from the first position to the second position in a plane that is parallel to a surface of the tray that supports a container.

22. The refrigerator of claim 19 wherein the obstruction member is configured to move from the first position to the second position in a plane that is parallel to a cross section of the outlet of the communication chute.

* * * * *